US006882804B2

(12) United States Patent
Eskey

(10) Patent No.: US 6,882,804 B2
(45) Date of Patent: Apr. 19, 2005

(54) FUSER AND FUSING ROLLER USEABLE IN A PRINTING PROCESS, LASER PRINTER, AND METHOD OF PRINTING

(75) Inventor: Eric Unger Eskey, Meridian, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 13 days.

(21) Appl. No.: 10/437,820

(22) Filed: May 13, 2003

(65) Prior Publication Data

US 2004/0228667 A1 Nov. 18, 2004

(51) Int. Cl.[7] ..... G03G 15/20

(52) U.S. Cl. ..... 399/45; 219/216; 399/69; 399/330; 399/334; 432/60

(58) Field of Search ..... 399/45, 67, 69, 399/328, 330, 334; 219/216; 432/60

(56) References Cited

U.S. PATENT DOCUMENTS 4,585,325 A * 4/1986 Euler ..... 399/69
5,708,949 A * 1/1998 Kasahara et al. ..... 399/330
6,298,215 B1 * 10/2001 Nomura et al. ..... 399/328
6,643,477 B1 * 11/2003 Mitsuoka et al. ..... 399/69

* cited by examiner

*Primary Examiner*—William J. Royer

(57) ABSTRACT

A printer fuser with a plurality of separately powerable heating zones along its length for permitting variably controllable heat application to a medium.

20 Claims, 6 Drawing Sheets

FUSER AND FUSING ROLLER USEABLE IN A PRINTING PROCESS, LASER PRINTER, AND METHOD OF PRINTING

BACKGROUND

Laser printers that employ fusing technology where a toner is heated to a malleable state for subsequent introduction to and bonding with a media substrate are commonly used in producing printed documents. In a typical desktop-type laser printer used in association with a computer, a fusing roller and a pressure roller work in cooperative unison to respectively provide thermal energy for making the toner malleable and provide pressure to force the malleable toner into fibers of the media substrate for permanent adherence. Inside the fusing roller is a heater that typically comprises a ceramic substrate with an electrical heating circuit provided thereon. The heater has one heat zone that extends substantially the entire length of the roller such that equal heat is emitted along this entire roller length.

When a typical sheet of paper having a usual width of about 8.5 inches is introduced between the fusing and pressure rollers in a normal print mode, the fusing roller, which has about the same width as the paper, provides heat for toner softening as printing occurs evenly over the width of the sheet.

Applicant has, however, discovered a number of problems with current fuser design. For example, where the printed media is narrower than the length of the fusing roller, the thermal energy emitted by the fusing roller lateral to the narrower media (e.g. an envelope) may become quite high and can create a significant thermal stress condition in the heating element at those sites outside the media dimensions. When combined with cyclical stresses induced by the on-off cycle of the printer and with roller mechanics in general, stress fractures and cracks can form in the heater. Should a crack form across the ceramic substrate causing a break in the associated electrical circuit, the printer may malfunction or entirely cease operation. Presently, a relatively thick, costly, and thermally inefficient ceramic heating element which is capable of withstanding considerable thermal stress is used in most printers.

Further, this thermal energy emitted lateral to the media to be printed can cause melting and deformation of any nearby plastic components of the printer mechanism or housing. In addition to causing printer damage and/or shut-down, these elevated temperatures can also adversely affect product quality. In particular, too much moisture may be driven out of the edges of the narrower media by the adjoining high heat. When this occurs, excessive media curl or wave caused by differences in moisture content across the media, develop and produce a product of substandard appearance. Presently, some printers employ a temperature monitor within the printer. When a sufficiently high temperature is reached, the monitor either slows or stops the printing process, an event that is not welcomed by a user.

Finally, electrical energy is wasted by most current printers during printing of smaller width media.

BRIEF SUMMARY

The subject matter here disclosed includes a fuser for causing malleability of a toner employed in a printing process. The fuser has a plurality of separate heating zones along its length, and at least two of these heating zones are separately powerable.

DETAILED DESCRIPTION

In one embodiment of a fuser, the fuser comprises a housing with a heater disposed therewithin. This heater includes at least two separate and separately controllable heating elements each having at least one heating zone, with each such heating zone disposed along a designated partial length of the housing. The heating zones of the separate heating elements together can span substantially the entire length of the housing as can be exemplified where the heating zones are positioned in tandem relation to each other within the housing. At least one of the heating elements may have at least two heating zones separated from each other to thereby form a space therebetween within which a heating zone of a second heating element may be disposed.

One non-limiting application of the present fuser is in a laser printer. In such an application, the fuser may be a fusing roller comprising a cylindrical roller member having a length dimension measured along its cylindrical axis. The cylindrical roller member has an electric heater operably associated therewith. The heater may comprise at least two separate and separately controllable heating elements each having at least one heating zone wherein each such heating zone is disposed along a designated partial length of the roller member. The heating zones of the separate heating elements together may span substantially the entire length of the roller member, and may be disposed in tandem relation to each other along the roller member. In one embodiment, one of the heating elements has two heating zones that are separated from each other to form a space therebetween and a heating zone of another heating element is located in this space. A pressure roller may be positioned within the printer for cooperative interaction with the fusing roller such that toner made malleable by the fusing roller is forced into fibers of media passing between the two rollers.

Another fuser embodiment comprises a fuser bulb which is located adjacent to a media path in the printer. The fuser bulb may have a plurality of heating zones along its length, with heat for each zone being produced from separately electrically powerable filaments within the bulb.

Heat may be applied to the different fuser heating zones with separately controllable heating elements such that activation of a first heating element may result in heat application at more than one site while activation of a second heating element may result in heat application at a single site separate from the heating zones of the first heating element. Finally, engagement of both the first and second heating elements of this fuser embodiment results in the production of heat in all heating zones. As is thus apparent, flexibility is provided with respect to heat application sites, with such flexibility permitting thermal application substantially only where heat is needed.

Figure 1:
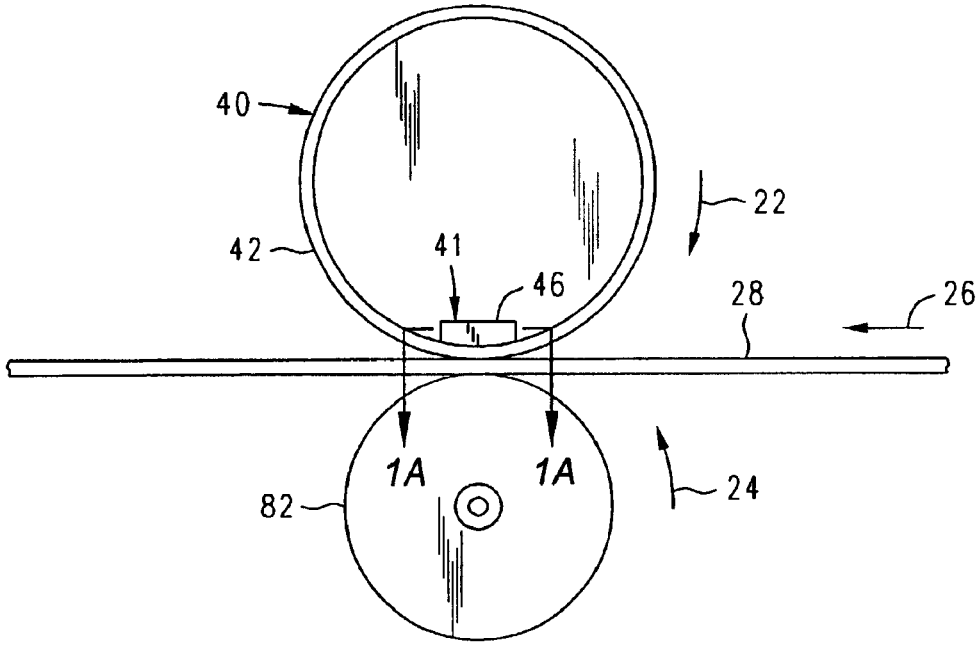
FIG. 1 is a schematic side elevation view of a fusing roller and pressure roller assembly in which an end portion of the fusing roller has been removed to show an internal heater.
Figure 1A:
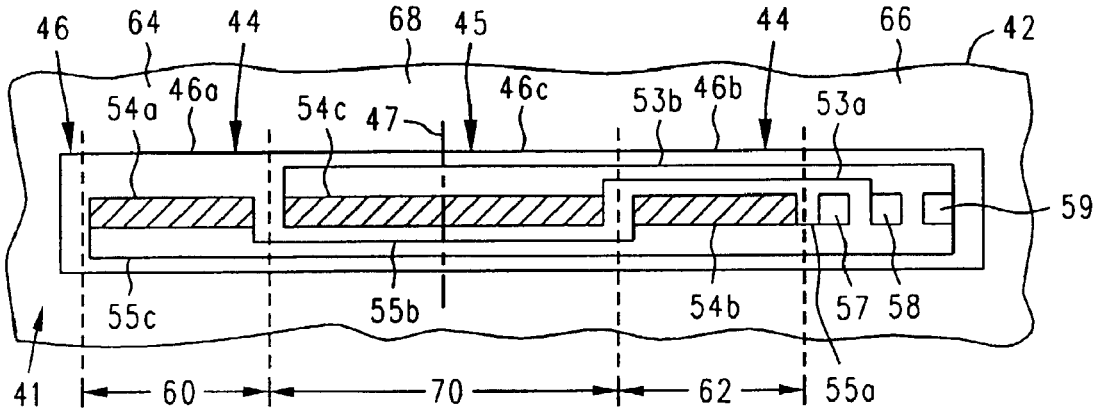
FIG. 1A is a front elevation view in section of a portion of the fusing roller of FIG. 1.

Referring now to FIG. 1, a fuser, non-limitingly here exemplified as a fusing roller 40, includes a hollow cylindrical housing 42 within which is mounted a heater 41 that extends substantially the entire length of the fusing roller. A pressure roller 82 is mounted opposite the fusing roller 40 and the two rollers rotate in directions 22, 24, respectively, to move a sheet of media 28 through the roller nip formed therebetween in direction 26. As shown in FIG. 1A, the heater 41 has a first heating element 44 and a second heating element 45. Each heating element 44, 45 is separately powerable as described below. The first heating element 44 may comprise two separate and spaced lengths of resistor material or resistors 54*a*, 54*b* located along spaced portions 46*a*, 46*b* of a ceramic substrate 46. The ceramic substrate is fixedly mounted on an interior surface of the roller, as by mounting means such as screws, rivets, adhesive, a sheet metal bracket structure, (not shown) or other suitable means of attachment. Heat transfer from the ceramic substrate to the housing 42 may be facilitated by thermally conductive grease (not shown) disposed between the ceramic substrate and the housing. Electrical conductor line 55*a* connects resistor 54*b* to a terminal 57. Electrical conductor line 55*b* connects resistor 54*b* to resistor 54*a*. Electrical conductor line 55*c* connects resistor 54*a* to a second terminal 59. Electricity passes through resistors 54*a* and 54*b* when an electric potential is applied across terminals 57, 59 as described in further detail below with reference to FIG. 7. The power source may be electrically connected to terminals 57, 59, by conventional means such as brushes or other means of electrical connection. The resistors shown are extremely thin, wide, high resistance portions of a metal trace, but could alternatively be a wire coil configuration or a serpentine configuration or any other resistor forming configuration mounted on or within the ceramic substrate portions 46*a*, 46*b*, such that high electrical resistance is encountered, and therefore heat is produced at each of the two lengths of ceramic substrate spaced portions 46*a*, 46*b* when current passes through the resistors 54*a*, 54*b*. Thus resistors 54*a* and 54*b* and the respective ceramic substrate portions 46*a*, 46*b* on which they are mounted provide two heating zones 60, 62. Each heating zone 60, 62 is disposed along a designated partial length of the housing 42 and in conjunction with the locations of the separate lengths of ceramic substrate portions 46*a*, 46*b*. The designated partial lengths of the housing 42 are in this embodiment at opposite lateral sites 64, 66 of the housing 42, resulting in a space being provided at housing site 68 between the two housing sites 64, 66 and associated heating zones 60, 62. The second heating element 45 comprises a single length of ceramic substrate 46c and an electrical resistor 54*c* mounted on ceramic substrate portion 46c. Resistor 54*c* is connected at one end by conductor 53*a* to terminal 58 and at the other end by conductor 53*b* to the second or common terminal 59. Heat is produced when current passes through resistor 54*c* providing heat at another heating zone 70 disposed along a designated partial length of the housing 42. The heating zone 70 may be sized and spaced to fit within the housing site 68 between the first and second heating zones 60, 62 such that the heating zones 60, 70, 62 are in tandem within the housing 42 and together span substantially the entire length of the housing 42 of the fusing roller 40, thereby producing a fusing roller 40 with three separate heating zones.

Figure 7:
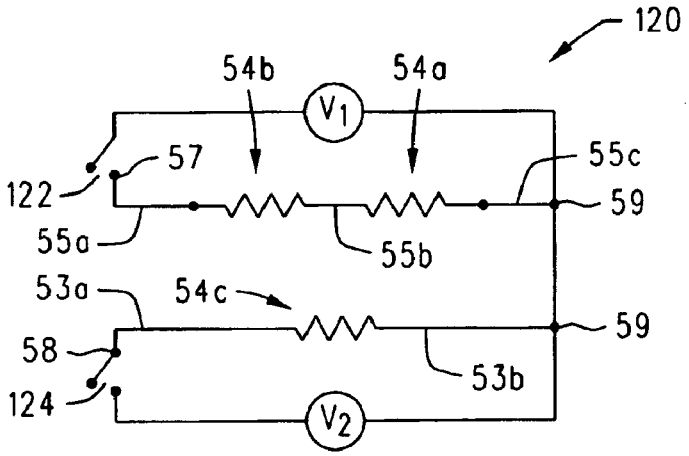
FIG. 7 is a circuit diagram of the heating circuit for the fusing roller of FIG. 1.

FIG. 7 shows the complete heating circuit 120 for the fusing roller 40. As shown, one circuit switch 122 associated with a first power source V1 controls the flow of current to resistors 54*a* and 54*b* and thus controls heating of heating zones 60 and 62. Further, another circuit switch 124 associated with a second power source V2 controls the flow of current to resistor 54*c* and thus heating zone 70. Alternatively the power sources V1, V2 could be variably controllable power sources, obviating the need for switches 122, 124. In such an embodiment the amount of heat generated by each heating zone could also be adjustably varied by adjusting each power supply between zero and a maximum setting.

The housing 42 of the fusing roller 40 may, for example, be constructed of sheet metal covered with a thin flexible plastic tube. Other suitable heat conductive material may also be used.

Figure 2:
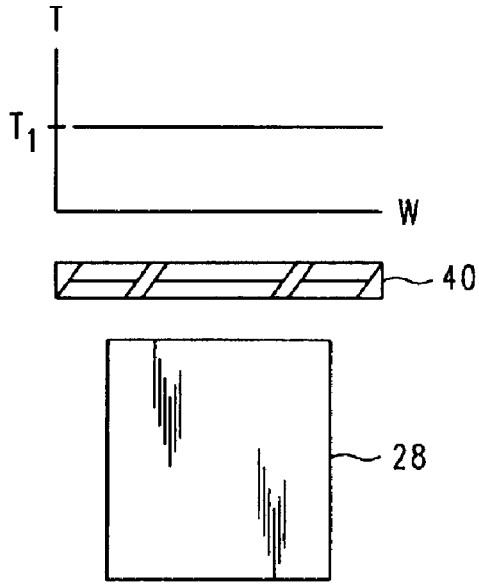
FIG. 2 is a schematic illustration of an embodiment of a thermal treatment by the fusing roller of FIG. 1 during passage of wide media upon which printed images are to be produced.
Figure 3:
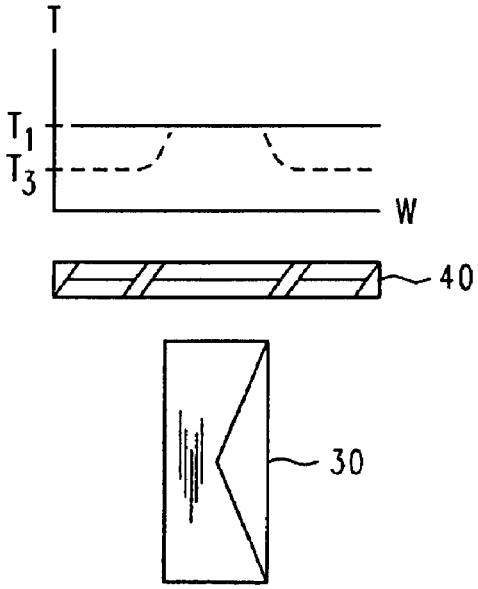
FIG. 3 is a schematic illustration of an embodiment of a thermal treatment by the fusing roller of FIG. 1 during passage of narrow media upon which printed images are to be produced.

FIGS. 2 and 3 illustrate the action of the fusing roller 40 of FIG. 1 with respect to both wide and narrow media to be printed. In particular, and as shown in FIG. 2, when wide media such as a standard 8.5×11 inch sheet of paper 28 passes the fusing roller 40 for printing, a uniform temperature $T_1$ (FIG. 2) is produced by the three heat zones 60, 62, 70 of the two powered heating elements 44, 45 along substantially the entire length of the roller 40 for an efficient and thermally favorable operation. Likewise, the present fusing roller 40 exhibits no undesirable thermal effects when narrow media is printed. Specifically, as illustrated in FIG. 3, when a number ten envelope 30 is presented to the fusing roller 40, only the second heating element 45 is powered. Consequently, only the heating zone 70 is thermally active to produce a $T_1$ temperature on and for a short distance on either side of a centerline 47 of the housing 42 of the fusing roller 40. Simultaneously, because the first heating element 44 is not powered and the heating zones 60, 62 thereof therefore are not thermally active, a temperature $T_3$, substantially equal to the ambient temperature of the overall printing environment, is maintained at the non-printing housing sites laterally outward of the respective edges of the envelope 30. This thermal control results in substantially no undesirable thermal effects on equipment or product, and thus represents a significantly beneficial advantage in equipment, work product, and energy conservation.

Figure 4:
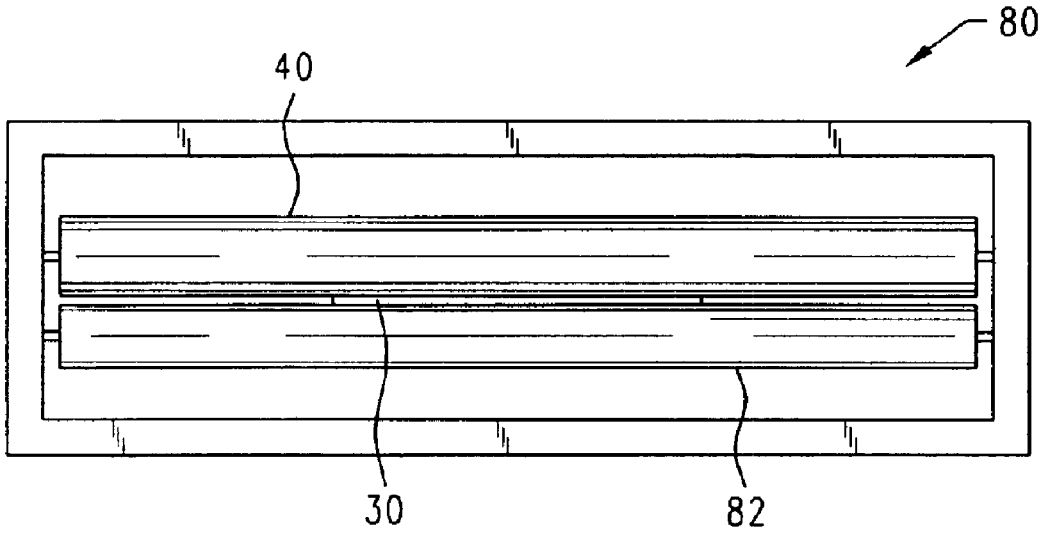
FIG. 4 is a front elevation view of a portion of one embodiment of a laser printer showing a fusing roller and a pressure roller.

FIG. 4 shows in section a portion of a desktop laser printer 80 with the fusing roller 40 as described above. As shown, the fusing roller 40 functions in cooperation with a pressure roller 82 as print media (e.g. a sheet of paper 28, an envelope 30, etc.) passes between the rollers 40, 82 and malleable toner is fused to the media as printed images. Specifically, heat from the heating zones 60, 62, and/or 70 of the heating elements 44, 45 inside the housing 42 of the fusing roller 40 apply heat substantially only across the width of the media to soften the toner such that as the media passes between the fusing roller 40 and the pressure roller 82, the pressure roller 82 forces the softened toner into the media and thereby produces a printed image on the media. Once so printed, the media conventionally passes from the printer 80 for receipt by an operator.

Figure 5:
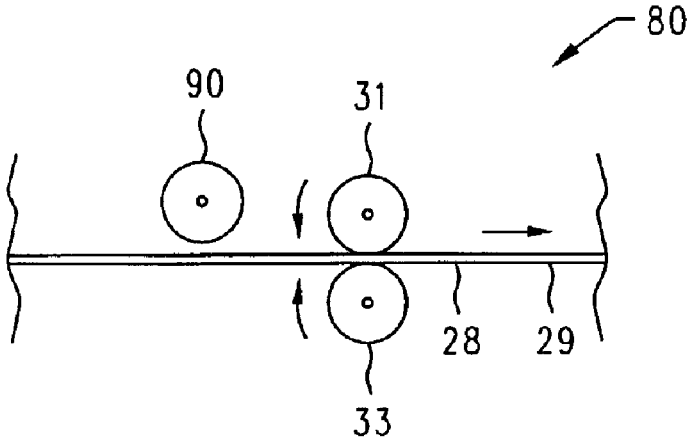
FIG. 5 is an end elevation view of a portion of another embodiment of a laser printer showing media operated on by a bulb fuser and pressure rollers in place.
Figure 6:
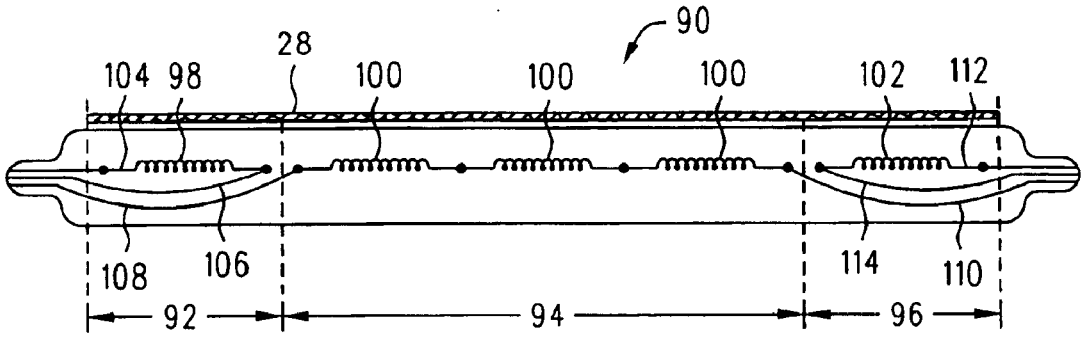
FIG. 6 is a front elevation view of the fuser bulb of FIG. 5 with an adjacent sheet of media shown in section.

Certain laser printers employ electrically powered bulb heat sources for toner softening. Such a bulb 90 is situated adjacent to the displacement path 29 of media to be printed, e.g. sheet 28 or envelope 30, as shown in FIGS. 5 and 6. Prior art bulbs are powered in much the same manner as prior art fusing rollers in that these bulbs have a single heating element that produces a uniform temperature along its entire length irrespective of the dimensions of the media upon which toner is being deposited. In the same manner that the prior art fusing roller produces unwanted and potentially detrimental heat when narrow media is being printed, the prior-art bulb likewise provides thermal energy where media surface is not present for toner application. Now, and in accord with the present subject matter, a new electrically powered fusing bulb 90 for a printer fitted with a bulb heat source is shown in FIGS. 5 and 6. In particular, the bulb 90 shown in FIG. 6 provides a plurality, here non-limitedly shown as three, heating zones 92, 94, 96 along its length, with heat being produced from a first group of separately electrically powerable filaments 98, 102 that form a first heating element and a second group of separately electrically powered filaments 100 that form a second heating element. Specifically, the filament 98 is heated by an electrical circuit including conductor lines 104 and 106 to produce the heating zone 92 and the filament 102 is heated by an electrical circuit including conductor lines 112 and 114 to produce the heating zone 96. The filaments 98, 102 may be electrically connected is series, like resistors 54*a*, 54*b* in the above described embodiment, such that they form a single heating element with two heating zones 92, 96. The filament 100 is heated by an electrical circuit including conductor lines 108 and 110 to produce the heating zone 94. Depending upon the length of the media upon which images are to be printed, only filaments 100, or all filaments 98, 100, 102 can be powered and thereby activate one, 94, or all three of the heating zones 92, 94, 96 to generally coincide with the dimension, be it narrow or wide, of the media to be printed, with such media dimensions being determined and transmitted as later described. In one embodiment the heating circuit for bulb 90 is substantially the same as the heating circuit described in reference to FIG. 7 for heater 41. Thus, in substantially the same manner as described in relation to the fusing roller 40 defined in FIGS. 1, 2, and 3, the fusing bulb 90 is powered along selected portions of its length dimension dependent upon the width dimensions of media being printed. The heat is transferred to. corresponding heat zones of a surrounding cylinder for efficient media heating and energy conservation. In an alternative embodiment of the fuser bulb 90, each of the filaments 98, 100, 102 is on a separately controlled circuit and provides a separate heating element, i.e. there are three elements and three separately controllable heating zones in such an embodiment. As shown in FIG. 5, in an alternative embodiment of the printer 80 of FIG. 4, fuser bulb 90 and a pair of pressure roller 31, 33 are substituted for fusing roller 40 and pressure roller 82. Bulb 90 is positioned adjacent to media displacement path 29. Toner on the media 28 is heated by bulb 90 and is subsequently pressed into the media by pressure rollers 31, 33 as the media moves along media path 29.

In another embodiment (not shown) the fuser bulb is positioned inside a heat conductive tube, e.g. an aluminum tube, and the tube is placed opposite a pressure roller in pressure nip forming relationship therewith.

While three separate heating zones are shown in the embodiments of FIGS. 1 and 6, it will be understood by those with ordinary skill in the art that any plurality (e.g. 2, 3, 4, 5, etc.) of heating zones created by any number of heating elements, which could be the same as or less than the number of heating zones, may be provided depending upon the range of media widths that are to be accommodated. Similarly, although specific heating circuits have been described, any number of differently controllable circuits could be employed.

Figure 8:
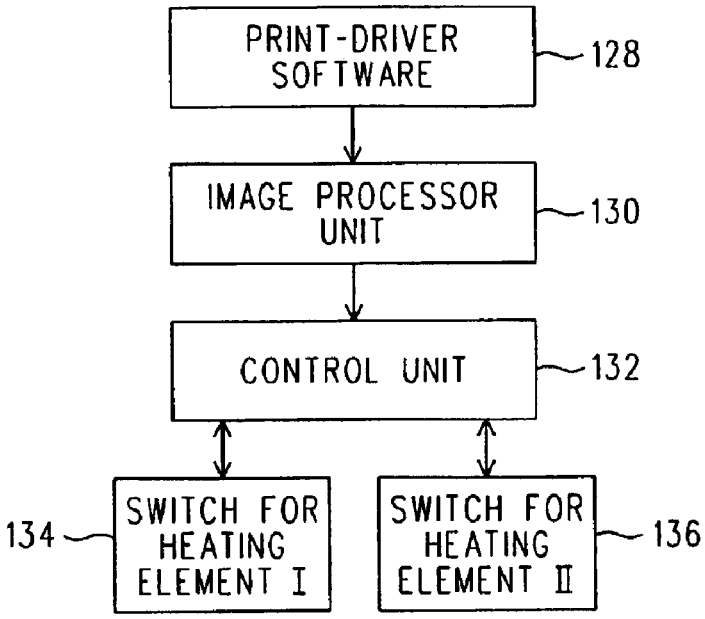
FIG. 8 is a block diagram showing operating components of a heating element activation system.
Figure 9:
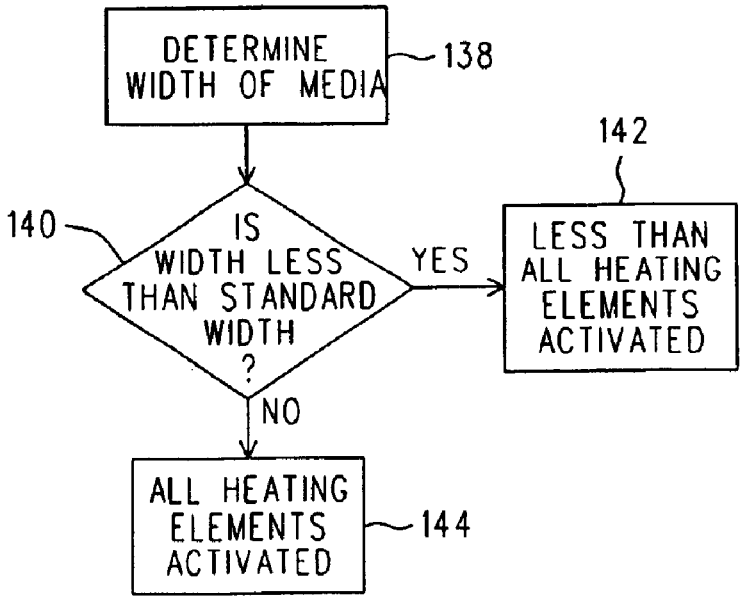
FIG. 9 is a flow diagram showing a process of heating element activation.

As previously indicated FIG. 7 shows one exemplary heating circuit 120 for a fusing roller 40. As shown, one circuit switch 122 with associated power source V1 controls the flow of current to resistors 54*a* and 54*b* while the other circuit switch 124 associated with power source V2 controls the flow of current to resistor 54*c*. Media width is first determined, with such width regulating the number of electrical circuits being activated. FIGS. 8 and 9 provide respective flow diagrams illustrating one manner of fuser activation of the fusing roller 40 which may be, but is not limited to, a software command. When such software is employed, the width of the media to be printed is first received by standard print-driver software 128 as commanded within a computer. Once the media width is so commanded, its value is transmitted to an image processing unit 130 of a standard printer which then activates a control unit 132 of the printer. The control unit 132 then activates the heating element controls 134, 136 (which in one embodiment comprise switches 122, 124) as appropriate for the width of the media to be printed. Specifically a first switch 122 controls power delivery to the first heating element 44 while a second switch 124 controls power delivery to the second heating element 45. Each such switch opens or remains closed to prevent or permit flow of electrical current in accord with the presence or absence of media and, if media is present, the width of media being introduced. Thus, when narrow media is introduced, only the switch 124 closes. Both of the switches 122 and 124 close when wide media is introduced. As an alternative to switches 122, 124 variably controlled voltage sources could be employed. Where a plurality of heating elements greater than two are provided, whether in a fusing roller 40 or in a bulb type fuser, an appropriate number of switches are provided in accord with the number of heating elements present such that only needed heating zones are heated through associated heating element activation in accord with media width to be printed.

FIG. 9 illustrates a methodology which may be used in the implementation of FIG. 8. In particular, the width of the media is determined 138 with respect to standard or less than standard width 140. Where the width is less than standard, less than all heating elements are activated 142. Conversely, where the width is standard, all heating elements are activated 144. The term "standard" with respect to media width refers to such width as fixed by the print-driver software 128 in accord with user input or a default setting provided as a command.

Figure 10:
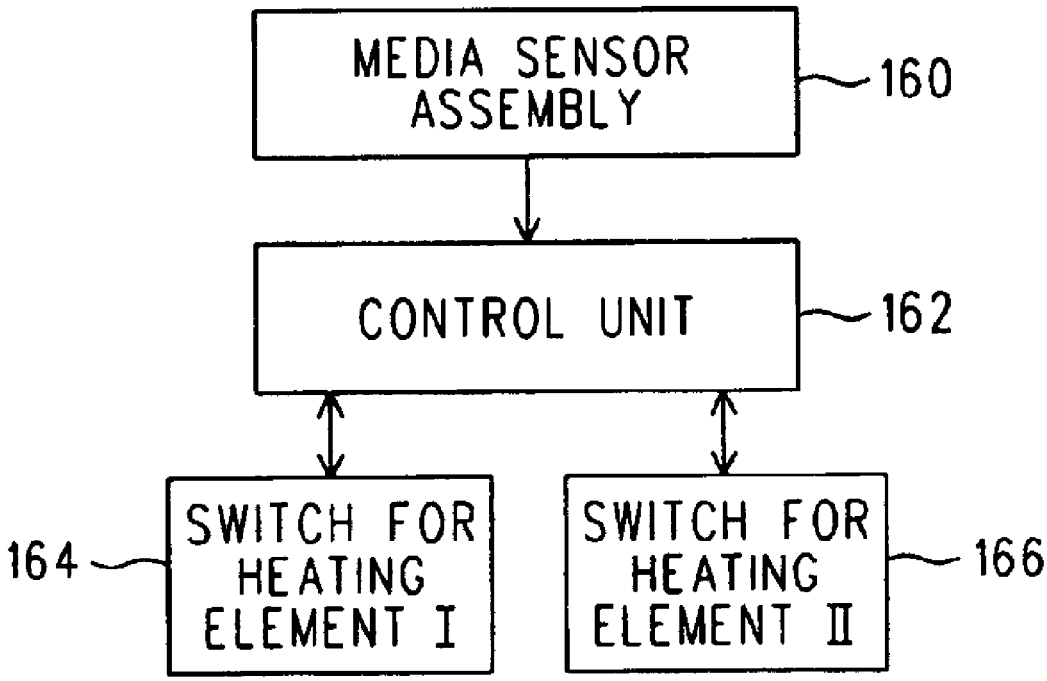
FIG. 10 is a block diagram showing operating components of an alternative heating element activation system.

FIG. 10 illustrates another control system embodiment in which a media sensor assembly 160 is cabled directly to a printer control unit 162 which then controls switches 164, 166 (or alternatively variable power sources) to control the heating elements. In one embodiment the sensor assembly 160 comprises a media width sensor. In another embodiment it further includes a sensor for sensing media thickness. In another embodiment it includes a sensor for sensing media grain direction. In a still further embodiment it includes a sensor for sensing the type of media material, e.g. glossy paper, matte finish paper, plastic, cloth, etc. The control unit in each case controls the heating unit to provide appropriate heating for the sensed condition or combination of conditions. What the appropriate heating for each condition or each combination of conditions is may be determined empirically and stored, as in a look up table, in memory accessible by the control unit 162.

What is claimed is:

1. A fuser for causing malleability of a toner employed in a printing process, the fuser comprising:

a) a housing having a length dimension;

b) a heater disposed within the housing, the heater comprising at least two separate and separately controllable heating elements each having at least one heating zone wherein each heating zone is disposed along a designated partial length of the housing; and wherein the heating zones of the heating elements are disposed in tandem relation to each other within the housing.

2. A fuser as claimed in claim 1 wherein the heating zones of the separate heating elements together span substantially the entire length dimension of the housing.

3. A fuser as claimed in claim 1 wherein at least one of the heating elements has at least two heating zones separated from each other and forming a space there between.

4. A fuser as claimed in claim 3 wherein a heating zone of a second heating element is disposed in the space.

5. A fuser as claimed in claim 1 wherein the fuser is a roller fuser.

6. A fuser as claimed in claim 1 wherein the fuser is a bulb fuser.

7. A fusing roller for causing malleability of a toner employed in a printing process, the fusing roller comprising:

a) a cylindrical roller member having a length dimension;

b) a heater within the roller member, the heater comprising at least two separate and separately controllable heating elements each having at least one heating zone wherein each heating zone is disposed along a designated partial length of the roller member; and wherein the heating zones of the heating elements are disposed in tandem relation to each other within the roller member.

8. A fusing roller as claimed in claim 7 wherein the heating zones of the separate heating elements together span substantially the entire length dimension of the roller member.

9. A fusing roller as claimed in claim 7 wherein at least one of the heating elements has at least two heating zones separated from each other and forming a space there between.

10. A fusing roller as claimed in claim 9 wherein a heating zone of a second heating element is disposed in the space.

11. A laser printer for furnishing printing toner to fibers of a print media and creating a printed product, the printer comprising:

a) a fusing roller for causing malleability of the toner, the fusing roller comprising:

i) a cylindrical roller member having a length dimension; and ii) a heater within the roller member, the heater comprising at least two separate and separately controllable heating elements each having at least one heating zone wherein each the heating zone is disposed along a designated partial length of the roller member;

b) a pressure roller for forcing the malleable toner into the fibers of the media; and wherein in the fusing roller the heating zones of the heating elements are disposed in tandem relation to each other within the roller member.

12. A laser printer as claimed in claim 11 wherein in the fusing roller the heating zones of the separate heating elements together span substantially the entire length dimension of the roller member.

13. A laser printer as claimed in claim 11 wherein in the fusing roller at least one of the heating elements has at least two heating zones separated from each other and forming a space there between.

14. A laser printer as claimed in claim 13 wherein in the fusing roller a heating zone of a second heating element is disposed in the space.

15. A fuser for a printer, the fuser comprising a length dimension and a plurality of separate heating zones along the length dimension wherein at least two of the heating zones are separately powerable and wherein the plurality of heating zones comprise a heater disposed within the fuser, the heater comprising at least two separate and separately controllable heating elements disposed in tandem relation to each other and each having at least one heating zone.

16. A fuser as claimed in claim 15, the fuser comprising a roller housing.

17. A fuser as claimed in claim 15, the fuser comprising a bulb housing.

18. A method of printing comprising:

a) determining the width of a medium to be printed;

b) adjusting the heating of a fuser based upon the determined width of the medium;

c) determining the thickness of a medium to be printed; and d) adjusting the heating of a fuser based upon the determined medium thickness.

19. The method of claim 18 further comprising:

determining the type of a medium to be printed; and adjusting the heating of the fuser based upon the determined type of medium.

20. The method of claim 18 further comprising:

determining the grain direction of a medium to be printed; and adjusting the heating of the fuser based upon the determined grain direction.

* * * * *

UNITED STATES PATENT AND TRADEMARK OFFICE

CERTIFICATE OF CORRECTION

PATENT NO. : 6,882,804 B2
APPLICATION NO. : 10/437820
DATED : April 19, 2005
INVENTOR(S) : Eric Unger Eskey It is certified that error appears in the above-identified patent and that said Letters Patent is hereby corrected as shown below:

IN THE SPECIFICATION

Column 5, Line 44, after “transferred to” delete “.”

Column 6, Line 21, after “activates” delete “the”

IN THE CLAIMS

Column 8, Line 4, after “each” delete “the”

Signed and Sealed this

Seventeenth Day of June, 2008

JON W. DUDAS
*Director of the United States Patent and Trademark Office*